United States Patent [19]

Weiss

[11] 4,431,406

[45] Feb. 14, 1984

[54] ROTARY HEARTH FURNACE PLANT

[75] Inventor: Hans J. Weiss, Frankfurt am Main, Fed. Rep. of Germany

[73] Assignee: Metallgesellschaft Aktiengesellschaft, Frankfurt am Main, Fed. Rep. of Germany

[21] Appl. No.: 344,661

[22] Filed: Feb. 1, 1982

[30] Foreign Application Priority Data

Feb. 12, 1981 [DE] Fed. Rep. of Germany ..... 3105073

[51] Int. Cl.[3] ..... F27D 15/02; F27B 9/16

[52] U.S. Cl. ..... 432/85; 202/136; 414/210; 414/216; 432/138

[58] Field of Search ..... 432/138, 139, 85; 414/210, 211, 216; 202/100, 104, 136

[56] References Cited

U.S. PATENT DOCUMENTS

| | | | |
|---|---|---|---|
| 2,676,006 | 4/1954 | Martin | 432/138 |
| 2,973,568 | 3/1961 | Greger | 432/138 |
| 3,594,287 | 7/1971 | Allred | 432/85 |
| 3,740,184 | 6/1973 | Oleszko | 432/139 |
| 3,763,011 | 10/1973 | Allred | 432/138 |
| 3,763,013 | 10/1973 | Allred | 202/100 |
| 3,998,703 | 12/1977 | Harrell | 432/138 |
| 4,096,038 | 6/1978 | Krauz et al. | 202/136 |

*Primary Examiner*—John J. Camby

*Attorney, Agent, or Firm*—Sprung, Horn, Kramer & Woods

[57] ABSTRACT

The rotary hearth furnace plant for heating granular high-carbon solids comprises an approximately funnel-shaped hearth, which rotates on a vertical axis and has a central outlet, which is disposed over a rotary table, on which the heated solids are moved by means of blades to an exit. The outlet of the rotary hearth furnace is disposed over the radially outer portion of the rotary table, which has a raised rim and a centrally disposed exit. A gastight hood is disposed between the rim of the rotary table and the rotary hearth.

4 Claims, 1 Drawing Figure

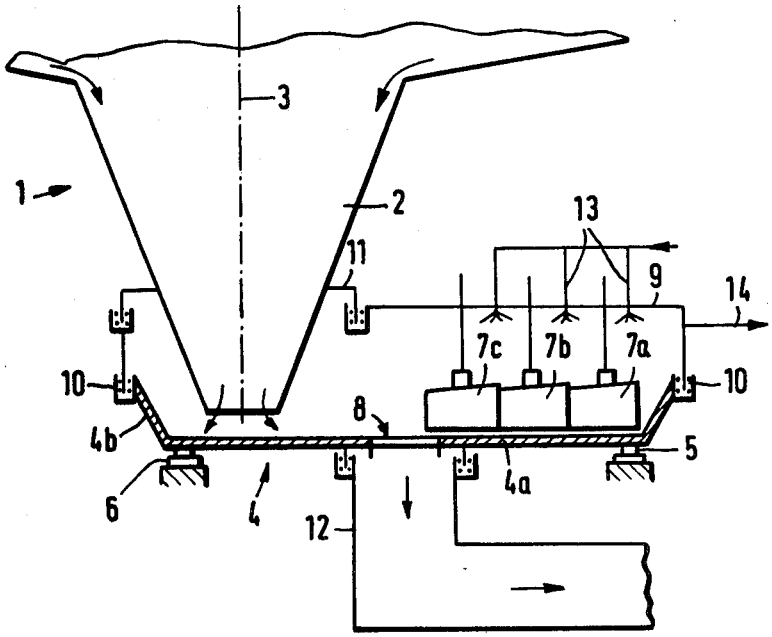
3
1
2
13
11
9
14
7c
7b
7a
10
10
8
4b
5
6
4
4a
12

ROTARY HEARTH FURNACE PLANT

BACKGROUND OF THE INVENTION

1. Field of the Invention

This invention relates to a rotary hearth furnace plant for heating granular high-carbon solids, comprising a substantially funnel-shaped hearth, which rotates on a vertical axis and has a central outlet, which is disposed over a rotary table, on which the heated solids are moved by means of blades to an exit.

2. Discussion of Prior Art

Rotary hearth furnace plants of that kind are known from German Offenlegungsschrift No. 21 63 829, German Nos. 22 21 635 and 26 04 667 and the corresponding U.S. Pat. Nos. 3,763,011; 3,740,184 and 3,998,703. They serve, e.g., for coking coal or for heating and calcining petroleum coke. The temperatures of the heated solids lie in the range from 400° to 1400° C., for coal in most cases between 600° and 950° C. and for petroleum coke in most cases between 900° and 1400° C.

In the known rotary hearth furnace plants, a rotary table is used for a continuous discharge of the hot solids flowing to the outlet of the hearth. The center of the rotary tables known from the above-mentioned patent publications is disposed under the conical outlet of the rotary hearth. Stationary, adjustable blades are provided, which move the hot solids of the rotary table outwardly to the rim thereof. The solids are then discharged across said rim through a suitable exit, which is succeeded by cooling and conveying means.

If the rotary table is centrally mounted in known manner, it is not possible to seal the rim of the table against the overlying hood in such a manner that an uncontrolled escape of hot solids across the rim of the table is reliably avoided. This is due to the fact that there must always be a gap between the rim of the rotary table and the stationary hood in order to permit a rotation of the table and a discharge of the hot solids. If hot solids, such as incandescent coke, escape through that gap at a point where a discharge is not desired, the solids may be ignited and this may result in dangerous fires or other risks.

In addition, the hot solids cannot be discharged continuously and uniformly as is desired because the hot solids must be removed by means of a stationary blade from the conical pile which is formed between the conical outlet under the rotary hearth and the rotary table and which rotates at relatively high speed. For this reason the rate at which hot solids are discharged during a rotation of the table at constant speed depends on the angle of repose, which may depend on grading, temperature etc.

For this reason, it is an object of the invention to provide a rotary table which, in the first place, allows the hot solids on the table to leave the table only through the exit which is provided and, in the second place, provides a more uniform discharge rate due to the fact that the discharge rate no longer depends on the angle of repose.

SUMMARY OF INVENTION

In a rotary hearth furnace of the kind described first hereinbefore, this is accomplished, in accordance with the invention, in that the outlet of the rotary hearth furnace is disposed over the radially outer portion of the rotary table, which has a raised rim and an exit disposed at the center of the table. Different from the state of the art, the hot solids coming from the hearth furnace are moved inwardly rather than outwardly on the rotary table and leave the rotary table through the exit disposed at the center of the table.

For a satisfactory movement of the solids on the rotary table, a plurality of stationary adjustable blades are suitably arranged over the rotary table in such a manner that the hot solids are pushed toward the center of the table by one blade width by each blade so that the solids move along concentric paths from the radially outer portion of the table to the center of the table and are removed there from the table through an opening.

At a given discharge rate of the overlying rotary hearth furnace, the rotary table according to the invention can be rotated at a lower speed in the range of up to 2 revolutions per minute and preferably 0.1 to 0.5 revolutions per minute whereas the speed of known rotary tables is about 3 or more revolutions per minute.

BRIEF DESCRIPTION OF DRAWING

The drawing is a diagrammatic longitudinal sectional view showing a rotary table and its relation to the rotary hearth furnace.

DESCRIPTION OF SPECIFIC EMBODIMENT

The rotary hearth furnace is shown only in part and comprises a slightly funnel-shaped rotary hearth 1, on which the solids are heated to fall finally into a central outlet 2. During operation, the hearth provided with the outlet 2 is rotated about a vertical axis, which is indicated on the drawing by the phantom line 3. In dependence on the mode of operation, the outlet 2 may be filled in part with hot solids and in that case serves also as a bin for subsequent degasification.

The rotary table 4 is disposed under the outlet 2 an has a horizontal bottom 4*a* and a raised rim 4*b*. The rotary table rotates on a vertical axis and is carried by rollers 5, which ride on an annular rail 6. The rotary table is driven in known manner by a motor via a pinion and a ring gear (not shown).

From the outlet 2, the hot solids flow initially to the radially outer portion 4*a* of the bottom of the rotary table and as the rotation of the table 4 is continued the solids are engaged by stationary blades 7*a*, 7*b* and 7*c*. The raised rim 4*b* of the rotary table prevents an uncontrolled escape of hot solids across the rim to the outside. The blades are oblique with respect to the direction of rotation of the solids and move the latter toward the central exit 8. Owing to the action of the blades, the heated solids are moved from the radially outer portion of the bottom 4*a* of the rotary table along a spirallike path inwardly to the exit 8. In the direction of rotation, the blades are disposed behind the outlet 2 of the rotary hearth.

A stationary hood 9 is disposed over the rotary table 4 and is immersed into a liquid-filled circular trough 10, which serves to seal the gap between the hood 9 and the rim 4*b* of the rotary table. That trough 10 may also be described as a water seal. Similar water seals are provided between the hood 9 and a cover 11, which is connected to the outlet 2, which is disposed under the exit 8. The hot solids dropping through the exit 8 into the chute 12 are carried away by means which are not shown, e.g., by a vibratory conveyor. If the hot solids are to be cooled on the rotary table, water nozzles 13 mounted in the stationary hood 9 may be used to spray water onto the hot solids in order to cool the latter. The resulting vapors are removed from the hood through the pipeline 14.

What is claimed is:

1. A rotary hearth furnace plant for heating granular high-carbon solids comprising a substantially funnel-shaped hearth, mounted for rotation about a vertical axis, said hearth having a central outlet, disposed over a rotary table, said rotary table attached to means for rotating the same about a vertical axis, at least one stationary blade disposed over said table to direct the heated solids from the outlet of the hearth toward an exit of said rotary table disposed at the center of the rotary table, a stationary chute disposed under the exit of the rotary table and gas tightly sealed against the rotary table, the outlet of the rotary hearth furnace being disposed over the radially outer portion of the rotary table, which rotary table has a raised rim and a stationary hood is disposed over the table between the rim of the rotary table and the rotary hearth, and means for feeding cooling medium to the heated solids on the table.

2. A rotary hearth furnace plant according to claim 1, wherein there are a plurality of stationary adjustable blades disposed over the rotary table in the direction of rotation behind the outlet of the hearth.

3. A rotary hearth furnace plant according to claim 1, wherein the feeding means comprises a plurality of water nozzles for cooling and/or moistening the hot solids, the nozzles being provided over the rotary table.

4. A rotary hearth furnace plant according to claim 1, wherein the rotary table is mounted on rollers, which ride on corresponding rails.

* * * * *